United States Patent [19]

Hausman

[11] 4,202,264

[45] May 13, 1980

[54] STRUCTURE FOR HYDRAULIC POWER APPARATUS

[76] Inventor: John M. Hausman, 2669 Wilbur Rd., Medina, Ohio 44256

[21] Appl. No.: 9,345

[22] Filed: Feb. 5, 1979

[51] Int. Cl.[2] ..... B30B 1/32

[52] U.S. Cl. ..... 100/269 A; 92/92; 254/93 HP

[58] Field of Search ..... 100/269 A; 92/91, 92; 254/93 HP; 144/281 A

[56] References Cited

U.S. PATENT DOCUMENTS

| | | | |
|---|---|---|---|
| 1,492,159 | 4/1924 | Caretta | 254/93 HP |
| 2,598,190 | 5/1952 | Offutt | 100/269 A |
| 2,869,173 | 1/1959 | van Hartesuelot | 100/269 A |
| 3,410,202 | 11/1968 | Chrubasik | 100/269 A |

*Primary Examiner*—Billy J. Wilhite

*Attorney, Agent, or Firm*—Oldham, Oldham, Hudak & Weber Co.

[57] ABSTRACT

An improvement to the hydraulic power apparatus for hydraulic presses is provided, wherein the seals and various gaskets for containing the hydraulic fluid in the press has an enclosed container substituted therefor. This enclosed container, in communication with hydraulic fluid reservoirs, provides the pressure for the ram in the hydraulic press. The container is inflatable with the pressure on the hydraulic fluid, but which fluid is never in direct contact with any of the structural mechanisms comprising the hydraulic power apparatus. The hydraulic power apparatus, hence, can be modified to increase the dimension of the ram to remove the gasket mechanisms and to provide an installation hatch which facilitates serviceability to the inflatable container.

9 Claims, 3 Drawing Figures

STRUCTURE FOR HYDRAULIC POWER APPARATUS

BACKGROUND OF INVENTION

This invention relates to an improved structure for the serviceability and performance of hydraulic presses, utilizing an enclosed hydraulic fluid container which eliminates the need for pressure or gasket fittings and increases the overall performance of the hydraulic power system. This invention also relates to the modification of existing conventional hydraulic power apparatus systems to accommodate the above-described invention.

Heretofore, numerous efforts have been made to isolate hydraulic or pneumatic fluids which serve to transfer power from one source under pressure to another source. For example, U.S. Pat. Nos. 699,936; 1,149,114; 2,773,482; and 3,206,159 teach the use of self-containerized interior cavities which stabilize the interior structure of the mechanism against power transmitted by another source. In this sense, the structures defined by these patents serve as resisting mechanisms which react to the movement of contiguous pieces powered from other sources.

U.S. Pat. Nos. 1,870,904; 2,191,861; 2,465,560; and 3,014,460 utilize self-contained mechanisms which alter their shape to power various pieces within the overall mechanisms. For example, U.S. Pat. No. 2,465,560 teaches the transmission of fluid into an expanding reservoir within the apparatus to power a piston.

All of the patents recited above disclose self-contained reservoir systems, which are assembled at the time of the construction of the entire apparatus, without provision made for the serviceability of any of the pieces during use. Substantial cost is incurred, should a breakdown in the internal components of the power system occur.

Hydraulic presses conventionally employ a hydraulic power system which places a ram within a ram pot, the two being separated by gasket means and gland rings. The ram is generally shorter than the ram pot, allowing a cavity to remain where hydraulic fluid, in an uncontained free flowing state, is pumped to achieve necessary pressure to lift the ram from the ram pot. The entire apparatus is dependent upon the ability of the fluid to remain pressurized within the cavity created between the ram and the ram pot. The gasket and gland rings are sources of common breakdown, and the expense to repair and service these items is in direct proportion to the expense of removing the ram from the ram pot and replacing the various seals contained near the upper portions of the apparatus.

The seepage of hydraulic fluid around the connections between the ram and ram pot, at the various gaskets, is a substantial problem for hydraulic presses commonly known in the art at the present time. Should a leak develop, the hydraulic pressure drops rapidly and the performance of the hydraulic press is seriously hindered. This may even develop into a dangerous situation causing human injury and property damage.

It has been found by the inventor that the maintenance and repair of hydraulic presses is costly to the operators thereof and once any portion of the ram or ram pot is cracked, or receives a serious structural blow, the entire apparatus is rendered worthless.

SUMMARY OF THE INVENTION

Consequently, it is an object of the invention to provide an improved structure for hydraulic power apparatus, wherein the hydraulic fluid is placed in an isolated container, utterly separated from any contact with the other mechanical parts of the power apparatus.

Another object of the invention is to provide an improved structure for hydraulic power apparatus, wherein the isolated container is capable of inflation and resistance to pressures exerted by the hydraulic fluid during operation.

Yet another object of the invention is to provide an improved structure for hydraulic power apparatus, wherein the inflatable pressure container may be subject to repeated expansion and contraction without serious structural deficiencies.

Moreover, it is another object of the invention to provide an improved structure for hydraulic power apparatus, wherein the inflatable pressure container is serviceable by access to its position within the hydraulic power apparatus without the necessity of removing any other mechanical component of the apparatus.

Yet another object of the invention is to provide an improved structure for hydraulic power apparatus, wherein the utilization of an inflatable pressure container eliminates any requirement for gasket or sealing structures at the contact point between any other portions of the hydraulic power apparatus.

Still another object of the invention is to provide an improved structure for hydraulic power apparatus, wherein the thickness of the walls of the power apparatus may be reduced because of the added containment of hydraulic fluid within the inflatable pressure container to prevent the hydraulic leaking during operation.

It is yet another object of the invention to provide an improved structure for hydraulic power apparatus, Wherein the inflatable pressure container substantially contacts the interior walls of the ram pot and the bottom surface of the ram without requiring additional structure to provide self-support of the container between and during use.

Still another object of the invention is to provide an improved structure for hydraulic power apparatus, wherein the conventional hydraulic presses and defective hydraulic presses may be modified to accommodate the inflatable pressure container, the elimination of gasket and sealing means, the elimination of interior ram guides, and the alteration of the sidewall of the apparatus to facilitate entry into the cavity existing between the ram and the ram pot.

These objects, and others which will become apparent as the detailed description of the invention proceeds, are achieved by: In a hydraulic press, an improvement to the hydraulic power apparatus devoid of fluid-sealing apparatus, comprising a ram pot, a ram, and an inflatable pressure container, said ram pot having smooth walled interior surfaces, said ram having smooth walled exterior surfaces and a bottom surface, said ram and said inflatable pressure container residing within said smooth walled interior surfaces of said ram pot, and said ram pot having restraining means for separating said ram and said inflatable pressure container during inactivity; said ram pot having an outer shell including a container installation aperture and a container installation hatch extending to said smooth walled interior surfaces; and said inflatable pressure container having a feed line attached thereto and having fluid contained therein.

The objects of the invention are also achieved by: An improvement to hydraulic power control mechanisms comprising: an enclosed, internally hydraulic container having means for expansion and contraction of said container in response to the hydraulic power control; a receiving structure within which said enclosed, internally hydraulic container resides; and a slidable structure against which said enclosed, internally hydraulic container pressurably contacts.

The objects of the invention including modification of hydraulic presses and defective hydraulic presses, are achieved by: A process of modification to improve serviceability and performance of hydraulic power apparatus having a ram, a ram pot, a gland ring, a ram gasket, internal ram guides, and hydraulic fluid, comprising: draining the hydraulic fluid, removing the ram, the ram gasket, and the ram gland ring from the ram pot; boring said ram pot to remove the internal ram guide; cutting an aperture into the surface of said ram pot and forming a hatch, said hatch joined with securement apparatus; inserting an inflatable pressure container through said aperture; and placing a ram follower into said bored ram pot, securing said hatch with said securement apparatus to said ram pot, and filling said inflatable pressure container with said hydraulic fluid.

DESCRIPTION OF THE DRAWINGS

For a complete understanding of the invention, reference is had to the following drawings, wherein.

When referring to corresponding members shown in the drawings and referred to in the specification, corresponding numerals are used to facilitate comparison therebetween.

DETAILED DESCRIPTION OF THE PREFERRED EMBODIMENTS

Figure 1:
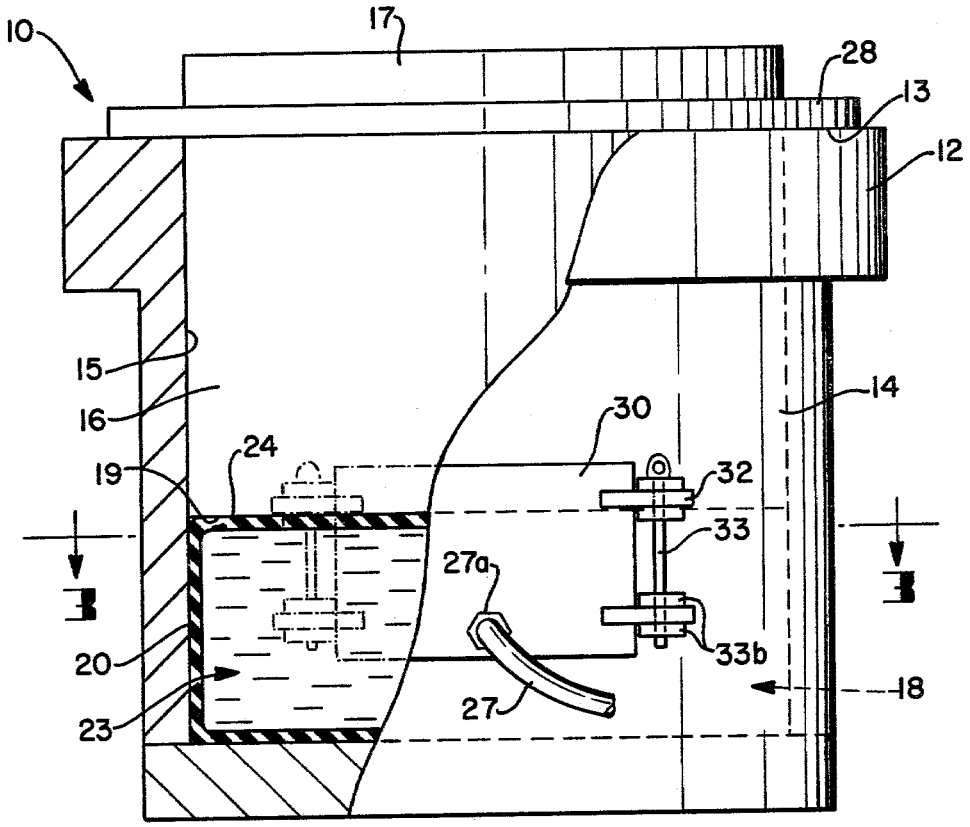
FIG. 1 is a partial cross-sectional side plan view of a hydraulic power apparatus of a hydraulic press.

Reference is made to FIG. 1 for an understanding of the structure of the improvements to hydraulic power apparatus 10. The hydraulic power apparatus 10 is composed of a ram pot 14 having an outer shell housing 12, a ram or follower 16, a bolster 17, and an inflatable pressure container 20. The interior surfaces 15 of ram pot 14 engage the exterior surfaces 11 of ram 16. The bolster 17 is secured into ram 16 by any method conventional to those skilled in the art. Between the bottom surface 19 of ram 16, and the outer surface 24 of inflatable pressure container 20 is a ram cavity 18, cavity 18 being created by a restraint mechanism upon the ram 16. This restraint mechanism may take the form of ram restraint flanges 28 located on the lower portions of bolster 17, and engaging the upper surface 13 of ram pot 14.

Figure 2:
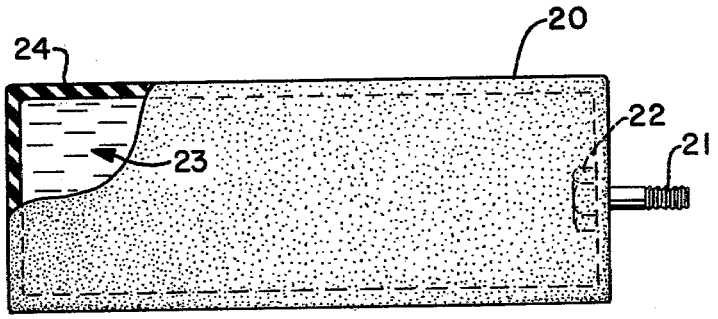
FIG. 2 is a partial cross-sectional side plan view of the inflatable pressure container.

Referring now to FIG. 2, an understanding of the structure of the inflatable pressure container may be achieved. The inflatable pressure container 20 is substantially cylindrical in shape, or any other solid geometric structure conforming to the interior surfaces 15 of ram pot 14. The inflatable pressure container 20 is an entirely enclosed structure wherein hydraulic fluid 23 may be housed. The hydraulic fluid 23 enters container 20 through container inlet 22 against which a container tap 21, with appropriate threading, may be attached by methods known to those skilled in the art. The movement of the hydraulic fluid into the container 20, through tap 21 and inlet 22, depends upon the desired pressure to be exerted on the container 20. The vessel 20 is without self-supporting structure, for it is designed to be placed within the ram cavity 18 to substantially engage interior surfaces 15 of ram pot 14 and bottom surface 19 of ram 16. The introduction of hydraulic fluid 23 by an exterior pumping mechanism from an exterior reservoir, into container 20, expands the inner surfaces 25 of the vessel 20 and forces the outer surfaces 24 to engage the contiguous interior surfaces 15 and bottom surface 19.

The inflatable pressure container 20 may be made from any type of elastomeric material commonly known to those skilled in the art, which has the properties capable of resisting chemical or physical degradation when placed in intimate contact with heated fluid 23. If the hydraulic fluid 23 is an oil, an oil-based derivative, or a lubricating organic chemical, specific polymers such as neoprene rubber may be used to successfully resist chemical and physical degradation. If hydraulic fluid 23 is aqueous, other types of container composition may be employed, recognizing the skill of those in the art to adapt and utilize the best composition.

The container 20 must be made of a composition which not only resists chemical and physical degradation, but provides adequate expansion and contraction properties sufficient to maintain its structural integrity over repeated hydraulic fluid operations. The elongation of the container 20 may permit expansion and inflation of the container to more than three times its uninflated size. Examining FIG. 2, with substantial contact of the outer surfaces 24 of the vessel 20 with the interior surfaces 15 of ram pot 14, the expansion of vessel 20 may force the ram 16 to slide a distance more than twice the overall height of the container 20 at rest. Therefore, the size of container 20 utilized in each hydraulic power apparatus 10 is dependent upon the amount of expanded, pressurized movement of the ram 16 out of ram pot 14. During such expansion of the outer surfaces 24 of container 20, significant pressure is placed on the structural integrity of container 20. The container 20 must be composed of material capable of withstanding greater than 8,000 lbs. psi pressure to achieve maximum expansion of the ram 16 out of hydraulic power apparatus 10.

Referring again to FIG. 1, hydraulic power apparatus 10 is equipped with a hydraulic feed line 27 which engages container inlet fitting 21. The hydraulic feed line 27 is attached to conventional pumping apparatus, known to those skilled in the art, for supply of hydraulic fluids under pressure. The pumping mechanism operatively connects to a substantial reservoir housing the hydraulic fluid 23 to be used in the apparatus 10. A conventional valve (not shown) connects the feed line 27 to the reservoir when the bladder is to be drained and the ram lowered.

Figure 3:
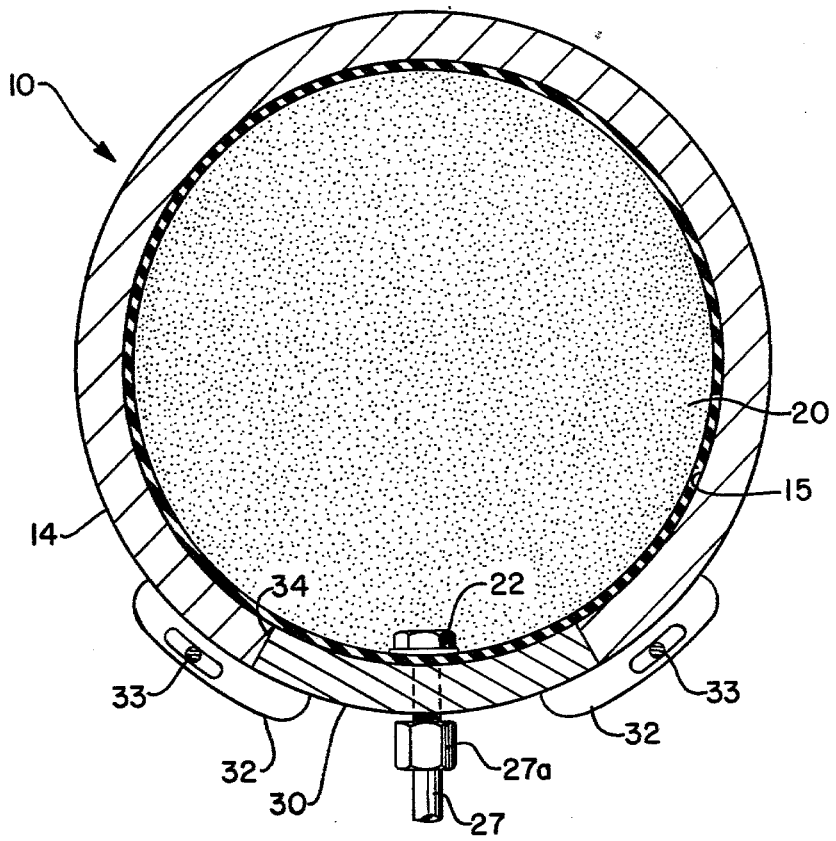
FIG. 3 is a cross-sectional top plan view of the installation aperture and hatch as seen on line 3—3 of FIG. 1.

An installation hatch 30 has been formed in the side of the ram pot 14 and it is secured to ram pot 14 by appropriate securing apparatus. Typically, the installation hatch is removable without any hinging of the hatch 30 on ram pot 14. Referring to FIG. 3, taken on line 3—3 of FIG. 1, it may be seen that the installation hatch 30 extends through the entire thickness of the wall of ram pot 14. The contact between ram pot 14 and hatch 30 is a substantially contiguous fit at installation aperture 34. Securing lugs 32 on the hatch 30 extend circumferentially of the ram pot and receive lock pins 33 of any suitable size in holes 33*a* in the lugs. The pins are secured to the ram pot by pairs of brackets 33*b* adjacent the upper and lower surfaces of the lugs 32.

The hatch 30 is of suitable size so that the inflatable bladder can be inserted into or removed from the ram pot when the hatch is removed. The resilient bladder 20 is of suitable shape and material as to fill the lower part of the ram pot but be expanded under pressure to move the ram. The bladder has its inlet and outlet fitting 21 conventionally connected thereto and the tubular fitting 21 extends through the hatch 30. A coupling 27*a* on the end of the fluid supply line 27 engages the threaded fitting 21 to secure the fitting in place and to connect the fluid pressure supply thereto. The fitting 21 is retained in engagement with the hatch 30, in any suitable manner, as the bladder 20 is assembled in the apparatus.

Because of the use of inflatable pressure container 20, in substitution for the free-flowing and unencumbered hydraulic fluid existing generally between ram 16 and ram pot 14, there is no need to include any gland ring, gasket and sealing mechanisms, or internal ram guides which currently exist in those hydraulic power apparatus known to those skilled in the art. The entire power transfer occurs at the engagement of inflatable pressure container and interior surfaces 15 and bottom surface 19. This eliminates any pressure sealing contacts at the upper surfaces 13 of ram pot 14 and may substantially reduce the thickness of the walls of ram pot 14 because of the enclosed hydraulic fluid 23 within container 20 with general pressure against ram pot 14 than previously existed when the hydraulic fluid 23 moved unencumbered within the entire ram cavity 18. Elimination of the need for internal ram guides on the interior surfaces 15 of ram pot 16, about the free flowing hydraulic fluid 23, permits the utilization of a ram 16 having a substantially greater diameter than what previously was permissible. This expansion of the diameter of the ram 16 affords greater surface area contact of the hydraulic power apparatus 10 with the hydraulic press and achieves substantially greater performance for the same energy expended in transmitting the hydraulic fluid into the apparatus 10. Further, the ram 16 and ram pot 14 may assume any solid geometric shape without regard to fluid leakage at corners, because fluid 23 is enclosed with container 20.

The installation hatch 30 may be removed to afford access to the container 20 located within ram cavity 18. Servicing of container 20 eliminates the need to remove gland rings and gaskets from ram pot 14, as presently existing when service on the pressure fluid contacts necessitated removal of the ram seals and rings to adjust and repair the gasket and sealing mechanisms, gland rings and other items eliminated by the presence of container 20. In the age of modular construction in various structural arts, the container 20 may be replaced in a matter of minutes as compared to the substantial repair time and expense placed in repair of gaskets, sealing mechanisms, and adjustments to the ram within the ram pot.

The invention contemplates the construction of a hydraulic power apparatus 10 incorporating the above-described improvements. However, existing hydraulic power apparatus, even with defects which render the apparatus incapable of performance, may be adapted to accommodate the improvements of this invention. For example, the gasket, sealing means, and gland rings may be removed as necessary. The internal ram guides may be removed and the existing ram replaced by a ram of much greater diameter, improving overall performance of the apparatus 10. The ram pot 14 may be restructured to provide installation hatch 30, the material for installation hatch 30 being the section of ram pot 14 cut therefrom. Most importantly, hydraulic fluid may be removed from its free flowing ram cavity 18 and placed within container 20, the latter being placed through installation hatch 30 and into ram cavity 18. After these modifications, servicing and repair work on the remodeled apparatus 10 proceeds as described above for the apparatus constructed ab initio.

As mentioned above, even existing hydraulic power apparatus incapable of repair may be modified to include the improvements recited above. For example, any crack or separation in ram pot 14 or ram 16, which previously rendered the apparatus 10 unusable, is now made immaterial by the incorporation of container 20 into apparatus 10. Further, the use of container 20, in place of unencumbered and free flowing hydraulic fluid 23 throughout ram cavity 18, allows the apparatus 10 to be used in more strenuous and exacting circumstances where damage to the external housing will not affect the overall performance of the apparatus 10.

From the foregoing, it is perceived that an embodiment delineating these substantial improvements to conventional hydraulic power apparatus has been described. While this constitutes only the best mode and preferred embodiment, it is to be understood that the structure of the invention is not limited thereto or thereby. Therefore, for a complete understanding of the scope of the invention, reference is made to the following claims.

What is claimed is:

1. In a hydraulic press, an improvement to the hydraulic power apparatus, devoid of fluid-sealing apparatus, comprising:

a ram pot, a ram, and an inflatable resilient pressure container;

said ram pot having smooth walled interior surfaces, said ram having smooth walled exterior surfaces and a bottom surface, said ram and said inflatable pressure container residing within said smooth walled interior surfaces of said ram pot, and restraining means for separating said ram and said inflatable pressure container when pressure is released from said container;

said ram pot having a shell including a container installation aperture and a container installation hatch positioned in said aperture and forming an operative portion of said smooth walled interior surfaces; and, said inflatable pressure container having a feed line attached thereto and having fluid contained therein.

2. In a hydraulic press, an improvement to the hydraulic power apparatus, devoid of fluid-sealing apparatus, according to claim 1, wherein said inflatable pressure container resides contiguous with said bottom surface of said ram and said smooth walled interior surfaces of said ram pot; and said feed line having a portion passing through said hatch.

3. In a hydraulic press, an improvement to the hydraulic power apparatus, devoid of fluid-sealing apparatus, according to claim 2, wherein said inflatable pressure container has inner and outer surfaces, said fluid pressurably contacting said inner surfaces and said outer surfaces pressurably contacting said bottom surface of said ram and said smooth walled interior surfaces of said ram pot; and means on the outer surface of said ram pot operably engaging said hatch to secure it to said ram pot.

4. In a hydraulic press, an improvement to the hydraulic power apparatus, devoid of fluid-sealing apparatus, according to claim 3, wherein said inflatable pressure container has inlet means for connecting said feed line and transferring said fluid to and from said inflatable pressure container.

5. In a hydraulic press, an improvement to the hydraulic power apparatus, devoid of fluid-sealing apparatus, according to claim 1, wherein said container installation hatch has securement means for removedly attaching said hatch to said container installation aperture.

6. In a hydraulic press, an improvement to the hydraulic power apparatus, devoid of fluid-sealing apparatus, according to claim 1, wherein said restraining means for separating said ram from said inflatable pressure container during inactivity include an external flange operably carried by said ram for engaging said ram pot.

7. In a hydraulic press including a ram pot, and a ram, an improvement comprising:

an inflatable resilient pressure container positioned in said ram pot, said ram pot having a smooth walled interior surface, said ram having a smooth walled exterior surface and a bottom surface, said ram and said inflatable pressure container being positioned within said smooth walled interior surface of said ram pot, and said inflatable pressure container being completely confined in said ram pot by engaging said bottom surface of said ram and the interior surfaces of said ram pot, said ram pot having a shell including a container installation aperture and a container installation hatch removably positioned in said aperture and forming an operative portion of said smooth walled interior surfaces; and said inflatable pressure container having a feed line operatively attached thereto.

8. In a hydraulic press, as in claim 7, wherein said feed line operatively connects to said pressure container through said hatch; and securing means for said hatch are attached to the outer surface of said ram pot.

9. In a hydraulic press, as in claim 7, wherein said ram has external restraint guide means operably associated therewith for separating said ram from said inflatable pressure container when pressure is released from said container.

* * * * *